United States Patent [19]

Schramm et al.

[11] 4,150,617

[45] Apr. 24, 1979

[54] MODULAR SPLIT SCREEN HYDRO-EXTRACTOR

[75] Inventors: Eugene J. Schramm, Norristown; Jacob C. Geisel, Jr., West Chester, both of Pa.

[73] Assignee: Somat Corporation, Pomeroy, Conn.

[21] Appl. No.: 911,783

[22] Filed: Jun. 2, 1978

Related U.S. Application Data

[63] Continuation of Ser. No. 754,162, Dec. 27, 1976, abandoned, which is a continuation-in-part of Ser. No. 647,973, Jan. 9, 1976, abandoned.

[51] Int. Cl.[2] ..... B30B 9/14

[52] U.S. Cl. ..... 100/117; 100/122

[58] Field of Search ..... 100/43, 117, 145, 150, 100/122, 124; 210/314, 315, 497, 480, 492

[56] References Cited

U.S. PATENT DOCUMENTS

| | | | |
|---|---|---|---|
| 643,891 | 2/1900 | Bussells | 100/117 |
| 2,004,408 | 6/1935 | Hiller | 100/122 X |
| 2,709,957 | 6/1955 | Armstrong | 100/117 |
| 2,960,926 | 11/1960 | McKee | 100/117 |
| 3,394,649 | 7/1968 | Kemper | 100/43 |
| 3,943,034 | 3/1976 | Wallen | 100/117 |

*Primary Examiner*—Peter Feldman

*Attorney, Agent, or Firm*—Kane, Dalsimer, Kane, Sullivan and Kurucz

[57] ABSTRACT

In a hydro-extractor, a screw is disposed with an outer concentric cylindrical sieve. The sieve is formed of sections placed lengthwise of the screw, with each section capable of having the same or different size holes so that the extractor captures solids both large and small in a controlled manner and will dewater faster or slower with various combinations of sieve sections. Where a sieve section contains smaller size holes of higher density per unit area and is constructed of relatively thin gauge material, an outer back-up screen of thicker gauge material with large holes is utilized in order to support the thinner screen and cooperate in withstanding the pressures generated during dewatering. Therefore, modulation of the sieve sections may be accomplished both vertically and horizontally.

8 Claims, 5 Drawing Figures

MODULAR SPLIT SCREEN HYDRO-EXTRACTOR

REFERENCE TO RELATED APPLICATIONS

This is a continuation, of application Ser. No. 754,162, filed Dec. 27, 1976 now abandoned; which application is a continuation-in-part of application Ser. No. 697,973 filed Jan. 9, 1976, now abandoned.

BACKGROUND OF THE INVENTION

This invention relates generally to devices for extracting water and other liquids from liquid impregnated materials, such as waste and pulp, and more particularly, to such a unit in the form of a vertical helical screw undergoing relative rotation with respect to a surrounding drainage screen.

The device which is the subject of this invention finds particular use with a waste disposal apparatus or system wherein upon treatment of the waste material, means must be provided for separating the solids and the liquids from within a slurry. This waste disposal system in general, may include a pulper having a tank containing the waste material, fibrous material, garbage and other disposable waste in the presence of a high percentage of water, all being subjected to the disintegrating action of a rotatable impeller having suitable material disintegrating cutters. (See commonly assigned U.S. Pat. Nos. 2,729,146; 3,164,329; 3,584,800; 3,620,460 and 3,885,745.) In apparatus of this type there is associated with the tank discharge, a means for delivering the water-laden disintegrated material to a liquid extracting device often referred to as a hydro-extractor in which a helical screw is made to undergo rotation within a cylincrical sieve. The hydro-extractor separates the solids from the liquids by withdrawing the liquid from the material received from the pulper or selected disintegrating or mascerating unit. In U.S. Pat. No. 3,394,649, having a common assignee with this application, there is disclosed such a hydro-extractor in which there is a cylindrical screen or hollow cylindrical sieve surrounding the major portion of the screw.

SUMMARY OF THE INVENTION

The hydro-extractor of the present invention is an improvement over the apparatus of U.S. Pat. No. 3,394,649 as a result of the attainment of closer control over solids captured and water extracted.

It is an object of the invention to provide a hydro-extractor of the type described above in which the sieve is formed of a plurality of sections placed lengthwise, each section having different size holes. It thus will be possible to employ combinations of two or more of such sections to control capture of the solids and to obtain faster or slower water extraction depending on the size of the holes in each section. Where a selected section contains holes of reduced size of high density per unit area and is fabricated of relatively thin gauge material, an outer back-up screen with larger holes supports the thinner screen to withstand the high pressures encountered during dewatering.

It is a further object to provide apparatus of the foregoing type which is economically manufactured, is efficient, well suited for its intended purpose and capable of sieve section modulation both vertically and horizontally to alter the operating parameters in response to the waste material being handled.

BRIEF DESCRIPTION OF THE DRAWINGS

Other objects and advantages will become apparent from the following description which is to be taken in conjunction with the accompanying drawings, in which.

DESCRIPTION OF THE PREFERRED EMBODIMENT

Figure 1:
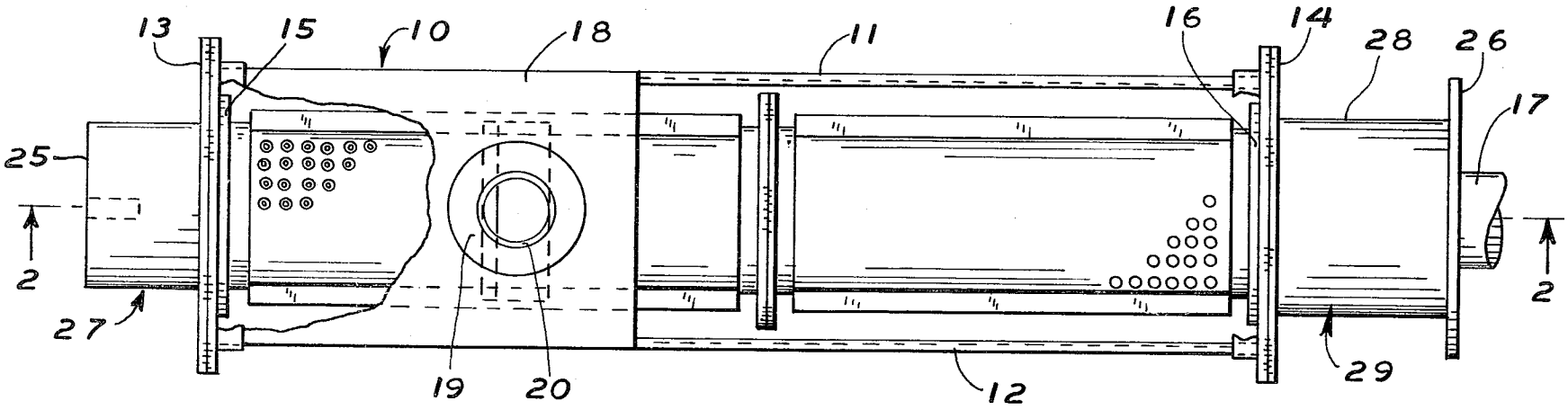
FIG. 1 is an elevational view of a liquid extracting device embodying the present invention with portions thereof cut away or removed to disclose certain details of construction.

Referring to the drawings, there is shown in FIG. 1 a liquid extracting device 10 having a shell consisting of vertically extending members 11 and 12 and end members 13 and 14 at either end. Affixed to the end members 13 and 14 are brackets or baffles 15 and 16 having openings through which a screw shaft 17 passes. A plate 18 provided with a baffle 19 with an opening through which passes a pulp or waste feed tube 20, and a plate 21 serve to complete the shell for the device.

The screw 22 of the hyro-extractor consists of a cylindrical screw shaft 17 having flights 23 providing an inclined surface in the form of a helix or screw surrounding and attached to the shaft. A cylindrical screen or hollow cylindrical sieve 24 surrounds the major portion of screw 22 in the zone between the baffles 15 and 16. One end of shaft 17 is supported in end bearing support 25 and the other end of the shaft is supported in end bearing support 26. The end bearing support 25 is part of a cap 27 affixed to the end member 13. The end bearing support 26 is spaced from the end member 14 and has cover plates 28 on the top and two sides to provide a pulp discharge chamber or zone 29. The material from which water has been extracted is fed by the screw into this chamber and then out of the open bottom of the chamber.

Means not shown are provided for rotating the screw 22 at the proper speed.

Figure 2:
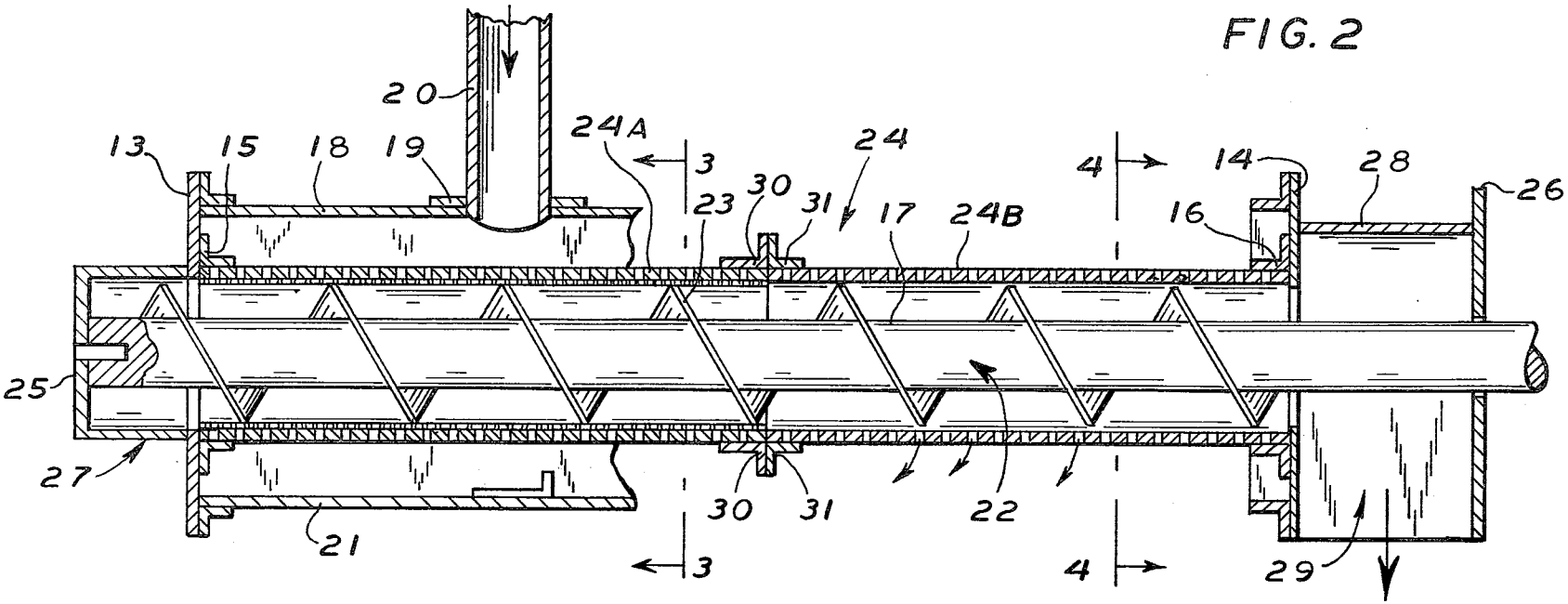
FIG. 2 is a sectional view taken along the line 2—2 of FIG. 1.
Figure 3:
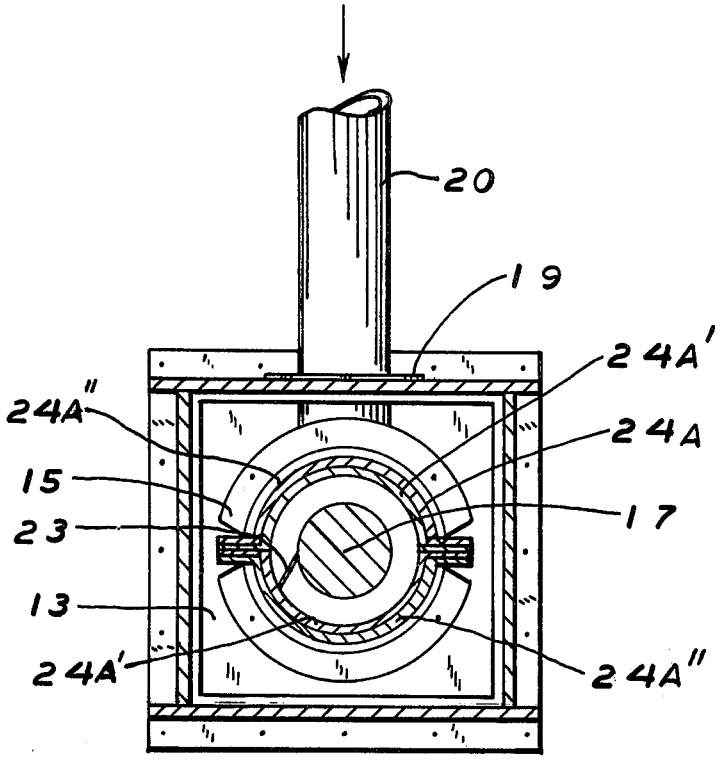
FIG. 3 is a sectional view taken along the line 3—3 of FIG. 2.
Figure 4:
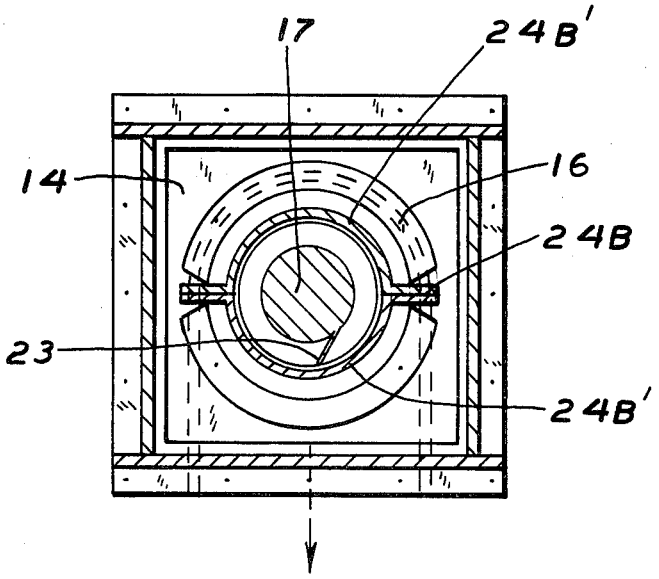
FIG. 4 is a sectional view taken along the line 4—4 of FIG. 2.

Referring to FIGS. 2, 3 and 4, it will be seen that the cylindrical screen 24 is made up of a plurality of sections bolted together at their ends to form the long screen 24. FIG. 2 shows two sections 24A and 24B having the same or different solids capture and water extraction characteristics held together at their ends by brackets or baffles 30 and 31. Such brackets or baffles 30 and 31 are similar to the brackets or baffles 15 and 16 at the opposite ends of such sections 24A and 24B. If necessary three or more sections can be secured together in the same manner to form the cylindrical screen 24 with each section having different or similar solids capture and water extraction characteristics.

Figure 5:
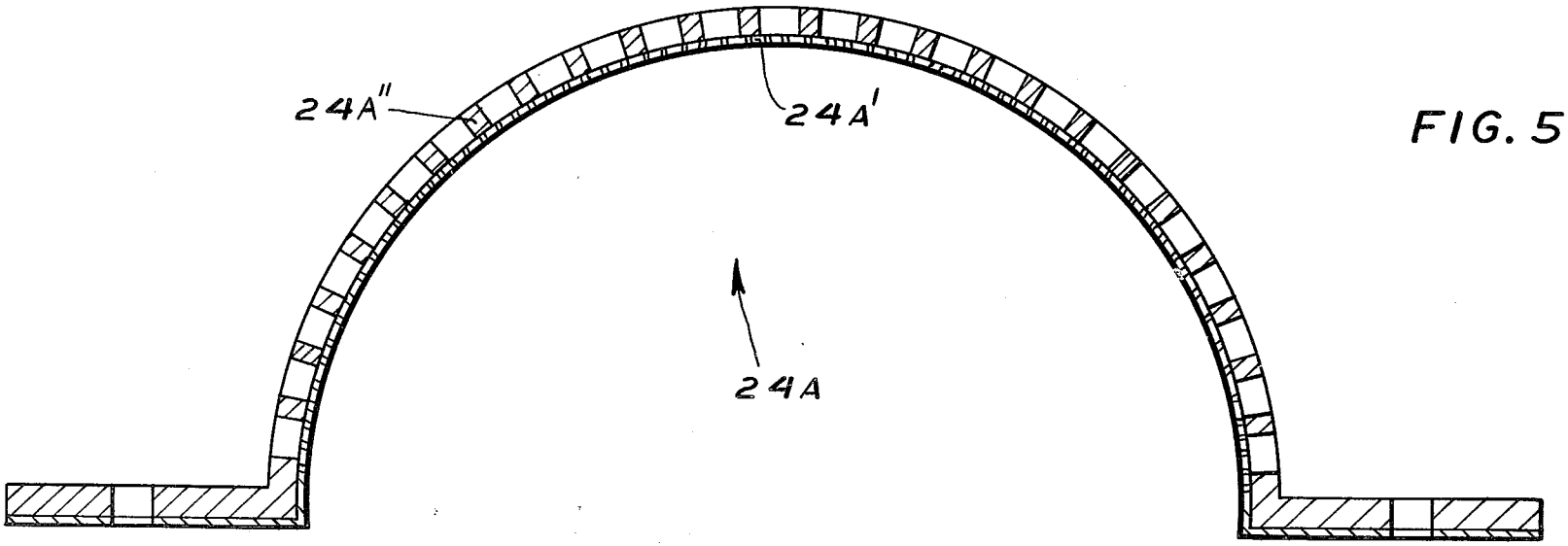
FIG. 5 is an enlarged sectional view showing a part of a supported sieve section.

In a particular application of the present invention, it was preferred that section 24A have relatively high solids capture characteristics. Towards this end, relatively small holes are formed in section parts 24A' and in all instances of screen manufacture it is preferred to optimize hole density, that is have as many holes of the selected size formed in the screen part; and in order to economically form the screen parts with the selected hole size, flat sheets of metal have the holes initially punched therein and thereafter the sheets are formed into the illustrated shape. The size of hole determines the gauge of metal selected for punching. In the stated particular application, the hole size was 0.032" but smaller size holes, as small as 0.02" are contemplated. Furthermore thin gauge metal for the small hole sizes if preferred because with thicker sheets and small diameter holes, there would be danger of the small holes with increased depth to clog with solids. However, when utilizing thin gauge section parts 24A', it is imperative to utilize back-up section parts or halves 24A" for support to enable parts 24A' to withstand the pressures encountered during dewatering. In the discussed application, the parts 24A" had 0.25" holes. FIGS. 3 and 5 show that the section 24A made up of parts or halves 24A', 24A" are secured together along their lengthwise edges.

In the stated application section 24B is designed to effectively dewater the solids captured by section 24A. Therefore, the hole size is larger; and in this connection it has been found that with hole sizes and sheet gauges of 0.062" and larger, no back-up or support is required. FIG. 4 shows the section 24B made up of two screens 24B' which are formed into two half cylinders secured together along their lengthwise edges.

Thus, merely for purposes of illustration, the first section parts 24A might be of 26 gauge and have 0.032" holes and back-up parts 24A" of 14 gauge and with 0.25" holes, the section 24B might have 0.062" or 0.093" holes. If a third section were used the second section might have 0.062" holes and the third section 0.093" holes. Although the open area on hole density may be varied it is preferred that the maximum number of holes be made in each section. For example, for sections having holes 0.032" in diameter and of substantially the indicated gauge, 400 punched holes per square inch could be utilized; and for sections having holes 0.25" in diameter and the indicated gauge, the open area equalled 58%. In this manner, depending on the application, the extractor will capture solids and dewater faster or slower by using the proper combinations of screens.

Since the operation of hydro-extractors is well known (see for example U.S. Pat. No. 3,394,649) it is not necessary to describe such operation. It will be apparent that the ability to select and combine screen sections with different size holes provides an opportunity for capture and drainage of waste material not found in the hydro-extractors of the prior art.

Thus among others, the several aforenoted objects and advantages are most effectively attained. Although somewhat preferred embodiments of the invention have been disclosed and described in detail herein, it should be understood that this invention is in no sense limited thereby and its scope is to be determined by that of the appended claims.

What is claimed is:

1. In the hydro-extractor of the type designed to receive a mixture of liquid and solids and to dewater the mixture to form a substantially solid dry plug of material therefrom having in combination a shell, a shaft within said shell, a helical screw formed on a portion of said shaft, inlet means for introducing said mixture at one end of said screw, a cylindrical sieve surrounding said screw and concentric with said shaft, a discharge space at the other end of said screw, and means for rotating said screw within said sieve to form and move said plug axially toward said discharge space, the improvement comprising:

a plurality of cylindrical sieve sections placed lengthwise to form said cylindrical sieve;

means for securing one of said cylindrical sieve sections adjacent the inlet means;

means for securing another of said cylindrical sieve sections adjacent the discharge space;

the section adjacent the inlet means being of thin gauge material having holes of relatively small size to increase the capture of solids of the mixture, the ratio of the thickness of the thin guage material to the size of the relatively small holes being such that clogging of said small holes is substantially prevented;

the thin guage material being so constructed as to be unable to withstand the pressues of dewatering;

an outer cylindrical support member supporting the section adjacent the inlet means so as to withstand the pressures during dewatering, said support member having holes of relatively larger size than those in the thin guage material; and the section adjacent the discharge space having holes of larger size than those in the section adjacent the inlet means to increase the dewatering of the captured solids.

2. The invention in accordance with claim 1, wherein means are provided for modulating said sieve sections to alter the operating parameters in response to the mixture being handled.

3. The invention in accordance with claim 2, wherein said means for modulating said sieve sections includes brackets at the ends of said sections.

4. The invention in accordance with claim 2, wherein said means for modulating said sieve sections includes baffles at the end of said sections.

5. The invention in accordance with claim 1, wherein the section adjacent the inlet means has approximately 0.032" holes.

6. The invention in accordance with claim 5, wherein the sieve section adjacent the inlet means has about 400 punched holes per square inch.

7. The invention in accordance with claim 1, wherein the section adjacent the discharge space has approximately 0.062" holes.

8. The invention in accordance with claim 1, wherein the section adjacent the discharge space has approximaterly 0.093" holes.

* * * * *